US006409409B2

(12) United States Patent
Bauman et al.

(10) Patent No.: US 6,409,409 B2
(45) **Date of Patent: *Jun. 25, 2002**

(54) TABBED DIVIDER AND POCKET CONSTRUCTION

(75) Inventors: Bruce D. Bauman, Tustin; Andrew S. Gordon, Los Angeles; Russ D. Pollman, Pomona, all of CA (US)

(73) Assignee: Avery Dennison Corporation, Pasadena, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/211,404

(22) Filed: Dec. 15, 1998

(51) Int. Cl.[7] ..... B65D 27/00

(52) U.S. Cl. ..... 402/79; 281/29; 281/31; 281/42; 281/45; 283/37; 402/70; 402/73; 229/67.1; 229/67.2; 229/67.3; 229/67.4

(58) Field of Search ..... 283/37; 402/79, 402/70, 73; 229/67.1, 67.2, 67.3, 67.4; 281/42, 29, 45, 31

(56) References Cited

U.S. PATENT DOCUMENTS

| | | | | |
|---|---|---|---|---|
| 1,495,953 A | | 5/1924 | Dick | |
| 3,528,602 A | * | 9/1970 | Ritchie | 281/38 |
| 3,839,809 A | | 10/1974 | Casas | |

(List continued on next page.)

OTHER PUBLICATIONS

Avery Double Pocket Dividers, 03075, copyright 1997, 1998, copy of package cover and one product sample.
Avery Pockets 'n Tabs Dividers, 81009, copyright 1997, 1998, copy of package cover and one product sample.
Avery WorkSaver Pocket Dividers with Insertable Tabs, PK2135, 1997, 1998, copy of package cover and one product sample.
Oxford Binder Buddies Multipocket Organizer, 00633, copyright 1997, package insert and one product sample.
Cardinal Poly Ring Binder Pockets with Index Tabs, copyright 1998, package insert and one product sample.
Cardinal Poly Ring Binder Pockets, copyright 1993, package insert and one product sample.

*Primary Examiner*—A. L. Wellington
*Assistant Examiner*—Mark T. Henderson
(74) *Attorney, Agent, or Firm*—Oppenheimer Wolff & Donnelly, LLP

(57) ABSTRACT

A foldable paper sheet is formed having a sheet body portion, a sheet lower side flap extending out from a lower side edge of the sheet body portion, a pocket panel extending out from a bottom edge of the sheet body portion, and a pocket side flap extending out from a side edge of the pocket panel. The pocket side flap is folded in towards the pocket panel, the pocket panel is folded up and the pocket side flap is glued to the back face of the sheet body portion. The sheet lower side flap is folded and glued to the pocket panel. The pocket panel is thereby secured along both side edges to the sheet body portion, has an open top and thus defines a pocket on the back of the sheet body portion. The pocket panel can have a finger notch at the center of its top edge. A tab is cut out of the edge portion of the sheet body portion to form a tabbed divider sheet. The tab advantageously can be formed at any location along the edge portion including at a lower location directly adjacent to the pocket. Binder holes were punched in the paper preferably during an early production step of the foldable paper sheet. Binder holes in the pocket panel, the side edge flap and the sheet body portion are in alignment with the foldable paper sheet folded and glued. Two of the binder holes in the body portion are spaced above the pocket, and to reinforce these holes the sheet includes an upper side flap. This flap also has two binder holes which with the flap folded onto and glued to the back of the body portion align with the two body portion holes.

54 Claims, 7 Drawing Sheets

U.S. PATENT DOCUMENTS

| | | | | | |
|---|---|---|---|---|---|
| 4,519,629 | A | | 5/1985 | Podosek | |
| 4,583,764 | A | | 4/1986 | Steffen | |
| 4,795,287 | A | | 1/1989 | Friedman | |
| 5,056,825 | A | | 10/1991 | Templet | |
| 5,299,879 | A | | 4/1994 | Burrow | |
| 5,447,334 | A | * | 9/1995 | Hartsock | 281/45 |
| 5,503,435 | A | | 4/1996 | Kline | |
| 5,540,513 | A | | 7/1996 | Wyant | |
| 5,558,454 | A | | 9/1996 | Owen | |
| 5,586,829 | A | | 12/1996 | Schwartz | |
| 5,597,256 | A | | 1/1997 | Burton et al. | |
| 5,599,128 | A | | 2/1997 | Steiner | |
| 5,722,694 | A | | 3/1998 | Baldursson | |
| 5,732,977 | A | | 3/1998 | Kohana | |
| 5,909,979 | A | | 6/1999 | Winzen | |
| D421,050 | S | * | 2/2000 | Henrikson et al. | D19/33 |
| 6,032,984 | A | * | 3/2000 | Ishida | 283/70 |
| 6,082,612 | A | * | 7/2000 | Black | 229/67.1 |
| 6,209,778 | B1 | * | 4/2001 | Henrikson et al. | 229/67.1 |
| 6,241,285 | B1 | * | 6/2001 | Duhr-Kravitz et al. | 281/29 |

* cited by examiner

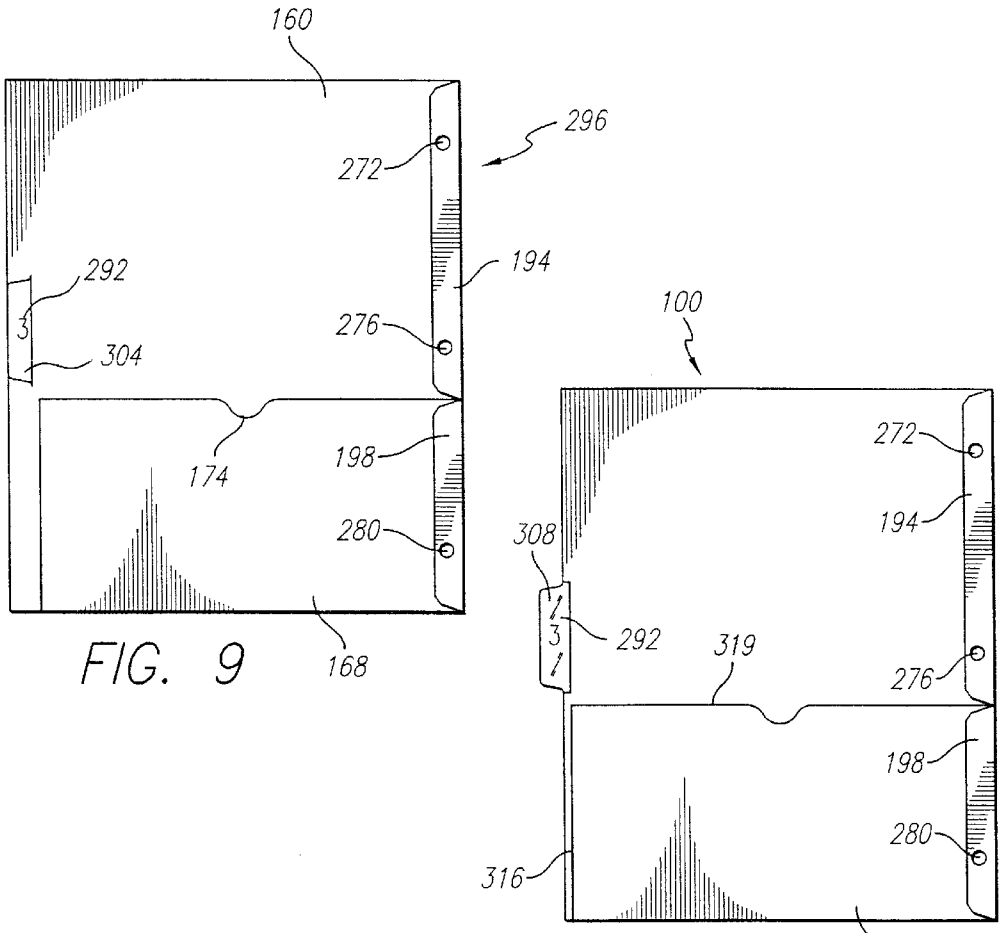
FIG. 10
FIG. 9
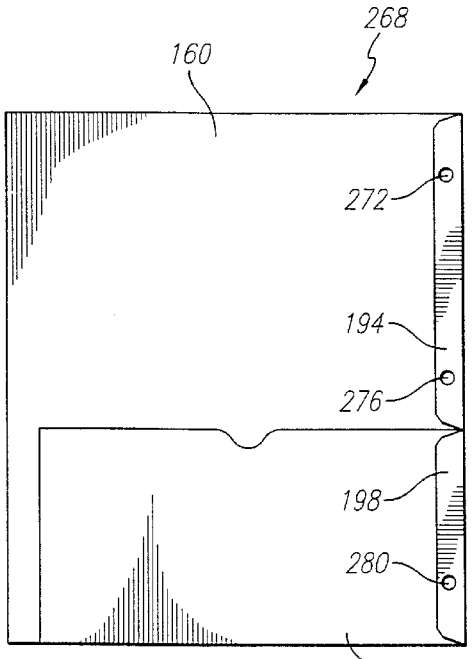
FIG. 8

TABBED DIVIDER AND POCKET CONSTRUCTION

BACKGROUND OF THE INVENTION

The present invention relates to tabbed divider and pocket assemblies and to methods of making them. It more particularly relates to those assemblies where the tab portion is formed from the same continuous paper sheet as the main sheet portion of the assembly.

An example of a prior art tabbed divider and pocket assembly is shown in FIGS. 1 and 2 generally at 20. This construction is marketed as the ONE-STEP product by Cardinal, which is part of Atapco Office Products Group of St. Louis, Mo. Assembly 20 is formed from a single paper sheet 24 which is cut, folded and glued. Sheet 24 has a main body portion 28, a pocket panel 32 at a bottom edge of the main body portion, a left pocket flap 40, and a right pocket flap 36. The pocket panel 32 is folded up to the main body portion 28, and the left and right pocket flaps 36, 40 are folded around the main body portion to the back side thereof and glued thereto as shown in FIG. 2. Thereby a pocket shown generally at 44 in FIG. 1 and having an open top 48 is formed on the front side of the main body potion 28.

Three binder holes 52, 56, 60 are formed on the left side of the assembly 20. While the top hole 52 passes only through the main body portion, the center and bottom holes 56, 60 pass through the pocket panel 32, the main body portion 28, and the left pocket flap 40, as can be understood from FIGS. 1 and 2. Also, as can be seen in those drawings, the top and bottom left corners 68, 72 of the assembly 20 are angle cut.

The tab 64 is formed by a tab portion 76 of the sheet 24 continuous with the main body portion 28. Indicia 80 is printed on the tab portion 68, and the tab portion has a colored protective coating 84 applied thereto. The assemblies 20 are typically sold in a packaged set with each assembly having its tab 64 at a different location along the right side and with a different indicia 80 printed thereon.

Because the right pocket flap 36 wraps around the side edge of the main body portion 28, the tab portion 76 cannot be positioned so as to extend out from the right edge of the main body portion where the right pocket flap is. In other words, the tab 64 cannot be positioned at the bottom couple of inches or so of the assembly 20, as shown by reference numeral 88, even when the angle cutout 92 is provided for the pocket 44. This is undesirable since it means that fewer locations of the tab 64 are available on the sheet 20.

Another pocketed tabbed divider known in the prior art is the POCKETS'N TABS index divider product available from Avery Dennison Corporation of Pasadena, Calif. Each of these dividers is formed from a (recycled) paper sheet having a sheet body portion, a right side flap extending out from a lower right side edge of the sheet body portion, a left side flap extending out from a lower right side of the sheet body portion, and a pocket panel at a bottom edge of the sheet body portion. To form the pocket the pocket panel is folded up towards the sheet body panel, and the two side flaps are folded and glued to the folded-up pocket panel. The results are that the pocket panel is on the front side of the sheet body portion and both of the side flaps are glued to the front side of the pocket panel. This prior art pocket divider is made by hole punching, cutting, sheeting, stripping, gluing and folding paper in a Kempsmith machine. The stacked paper sheets are delivered to a second machine where the tabs are attached. The second machines are made by Twinbrooks and EZ machines.

The pocket does not have the angle cut, such as angle cut 92 in assembly 20, but rather the top edge extends straight horizontally across the sheet. A deep four-inch continuous pocket is thereby formed, and the top edge of the pocket is below the middle ring binder hole. In other words, the top and center holes pass only through the main body portion and the bottom hole passes through the left side flap, the pocket panel and the main body portion.

The tabs of this Avery pocket index divider are formed by a separate transparent plastic piece. The plastic piece is folded over and its ends glued to the paper. The folded-over portion extends out from the side edge of the paper thereby defining a slot in which printed paper tabs with the desired indicia thereon are inserted and retained. Advantageously, these tabs can be positioned anywhere along the side edge of the sheet, even at the bottom corner and a tab position above, because the tab(s) is (are) secured at the front to the outside surface of the right flap and at the back on the rear surface of the main portion. The tabs above the pocket are secured directly to the front and back of the main body portion. Unlike the plastic tabs described above, tabs cut from the parent sheet (such as in assembly 20) can be preprinted in brighter more vibrant colors. Also, tabs cut from the parent sheet have a more desirable look and feel.

SUMMARY OF INVENTION

Disclosed herein are an improved tabbed divider and pocket assembly (assemblies) and a method(s) of making same. This assembly is formed by unwinding paper off of a paper roll and punching ring binder holes in a portion of the unwound paper. The portion of the paper is then scored, cut and sheeted and scrap paper stripped therefrom to form a foldable paper sheet. This sheet includes a sheet body portion, a lower side flap extending out from a side edge of the sheet body portion, an upper side flap extending out from the side edge above the lower side flap, a sheet pocket panel extending out from a bottom edge of the sheet body portion and a sheet pocket flap extending out from a side edge of the sheet pocket flap. The different portions of the sheet are separated from adjacent portions by scored or other types of fold lines.

The foldable paper sheet is introduced into the folding and gluing station. At this station, the pocket flap is folded towards the pocket panel, the pocket panel is folded up towards the sheet body portion, and the folded pocket flap is glued to the rear face of the body portion. The lower side flap is then folded and glued to the outward (rear) face of the pocket panel, and the upper side flap is folded and glued to the rear face of the body portion. With the flaps and pocket panel folded and secured in place, the two binder holes through the upper side flap align with the top two holes in the body portion to form the top two ring binder holes of the assembly. And the bottom ring binder hole is formed by the alignment of the hole in the lower side flap, the hole in the pocket panel and the bottom hole in the body portion.

At this stage in the manufacturing process a paper strip area extends out the side of the body portion opposite to the three binder holes. The strip includes the tab area for the assembly. Indicia is printed on the tab area at the desired location thereon, and the tab areas are coated with MYLAR, a polyester film. The tabs are then cut out of the strip area. The present invention advantageously allows the tabs to be cut at any location along the edge of the body portion, even at a lower location directly adjacent the pocket panel, unlike the prior art assembly 20 described above.

An alternative manufacturing process has the following steps, in the following order: (1) punch binder holes, die cut and score; (2) print indicia on tab on full, unfolded sheet; (3) apply MYLAR film and cut tab; and (4) fold and glue flaps and panel. Using this process the edge of the pocket can be aligned with the edge of the (tab) sheet, and thus no buffer strip is required.

Accordingly, an improved tabbed divider and pocket assembly is thereby formed including a tabbed divider sheet and a pocket having an open top formed on a back side of that sheet. A set of these products is formed, each product having its tab at a different location on the side edge and having a different indicia printed thereon. Each set is packaged, the packages boxed and the boxes distributed through retail channels or otherwise to the customer.

A variation of the invention is for the manufacturer to not print on the tab portion or apply a MYLAR coating thereto. In other words, the tab divider and pocket assembly would be provided to the user without printing, and the user can then print indicia of his/her choosing or not print any indicia if he/she so desires. Pursuant to an alternative embodiment of this variation, a coating which is receptive to laser or inkjet printing can be applied by the manufacturer on the tab portions to assist the user in a printing operation thereon.

Other objects and advantages of the present invention will become more apparent to those persons having ordinary skill in the art to which the present invention pertains from the foregoing description taken in conjunction with the accompanying drawings.

BRIEF DESCRIPTION OF THE DRAWINGS

FIGS. 8, 9 and 10 are views similar to FIG. 7 and illustrate subsequent second, third and fourth respective stages of the manufacturing process of the invention.

DETAILED DESCRIPTION OF PREFERRED EMBODIMENTS OF THE INVENTION

Figure 1:
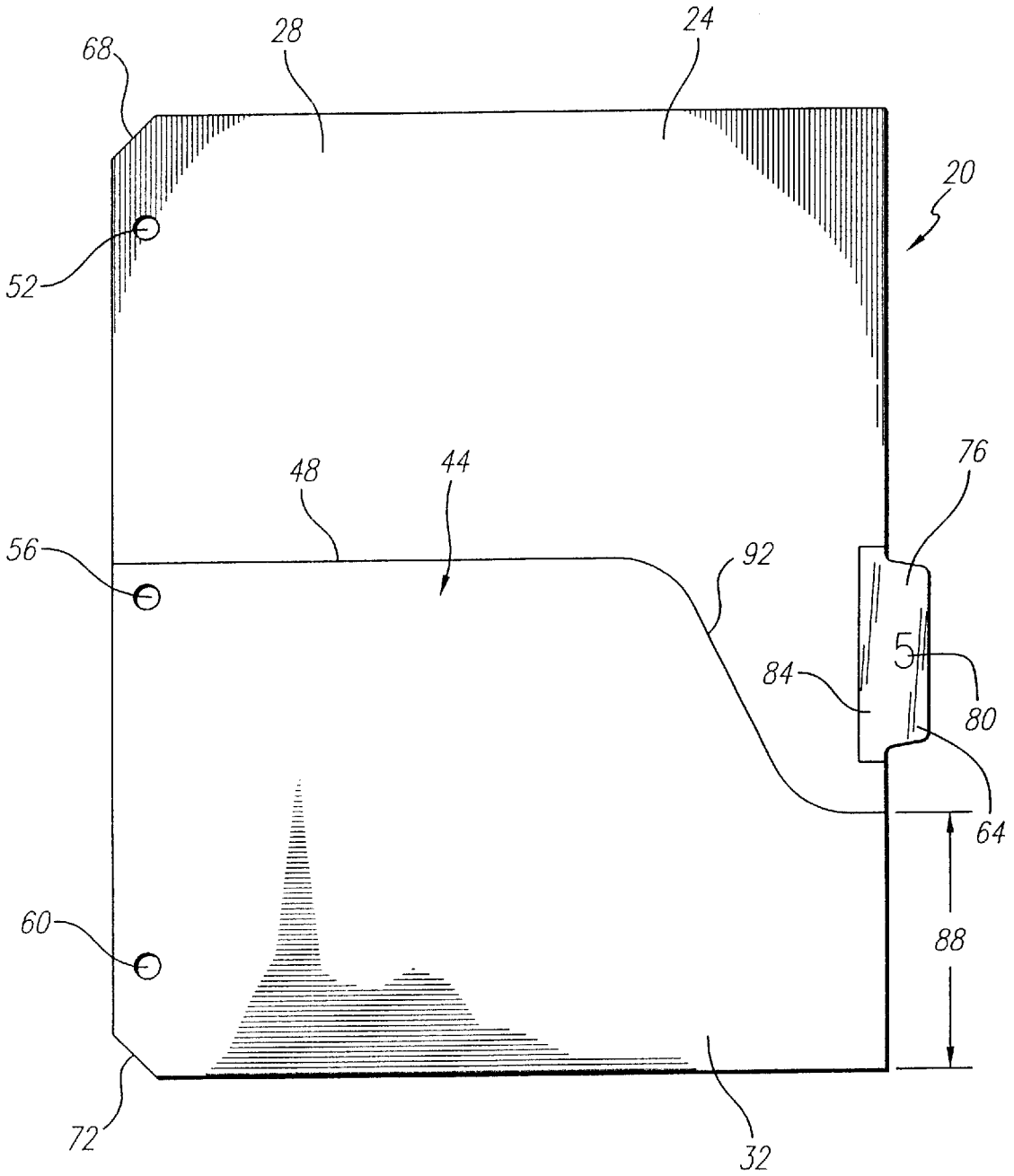
FIG. 1 PRIOR ART
FIG. 1 is a front elevational view of a tabbed divider and pocket assembly of the prior art.
Figure 2:
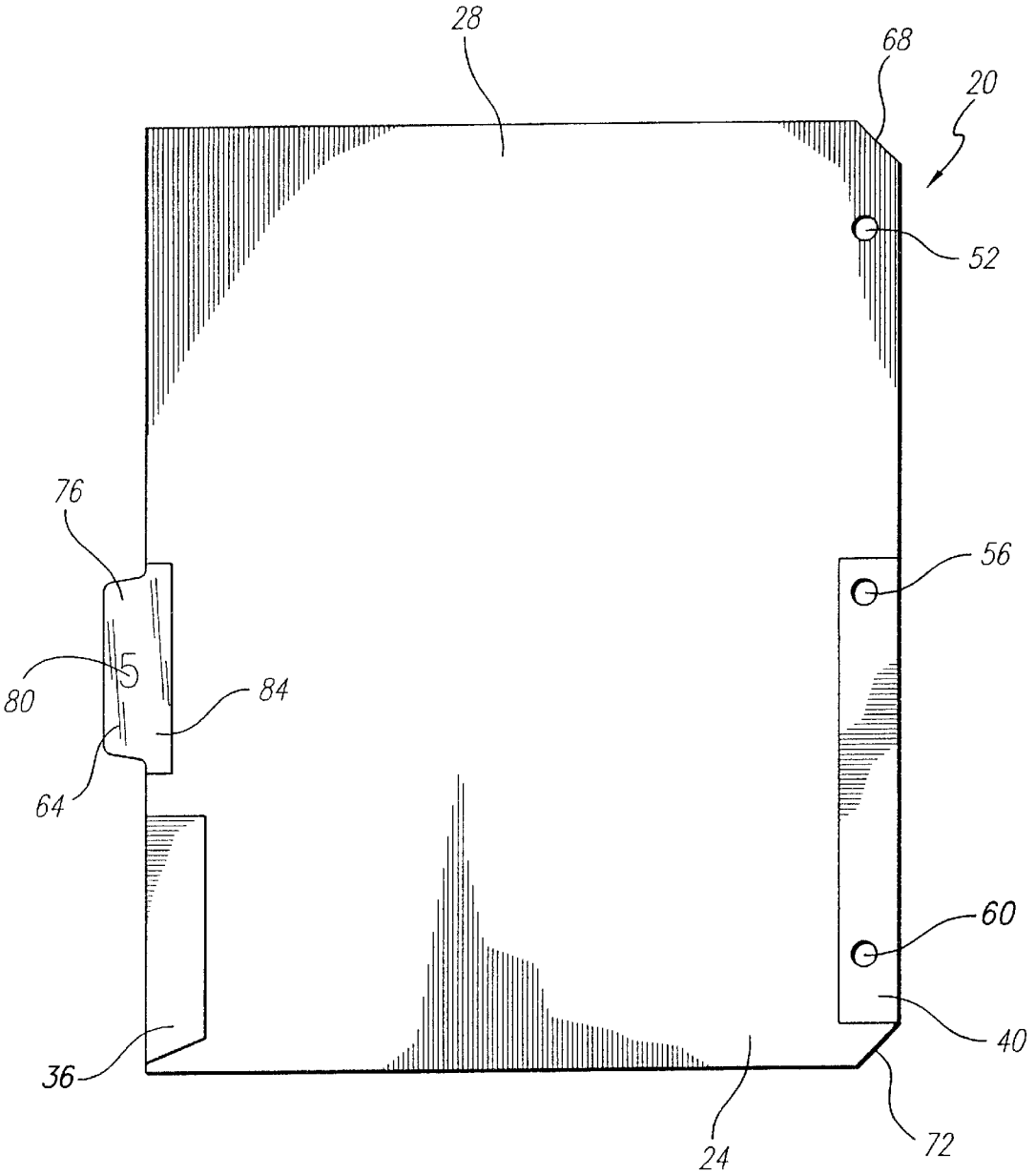
FIG. 2 PRIOR ART
FIG. 2 is rear elevational view thereof.
Figure 3:
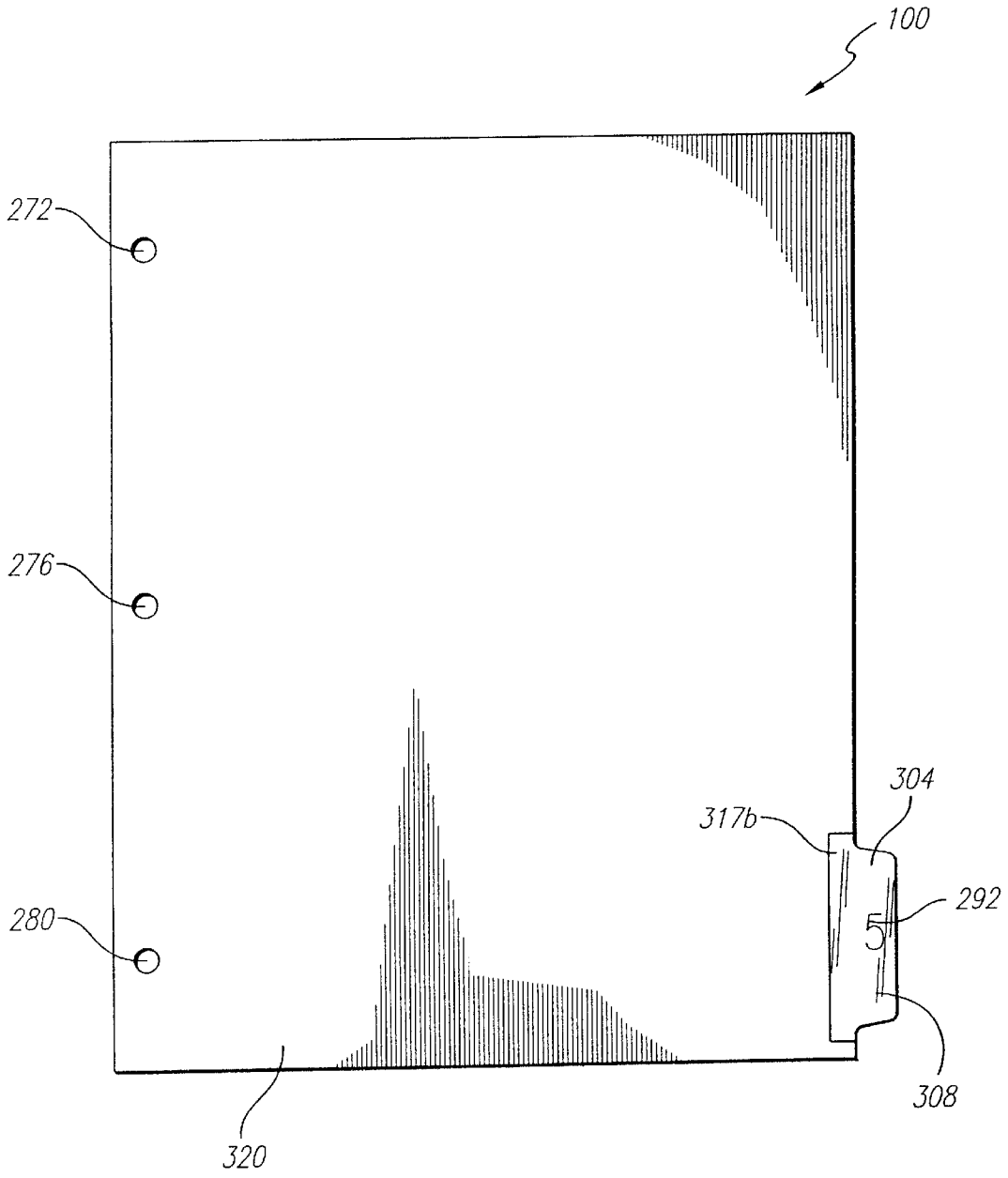
FIG. 3 is a front elevational view of a tabbed divider and pocket assembly of the present invention.
Figure 4:
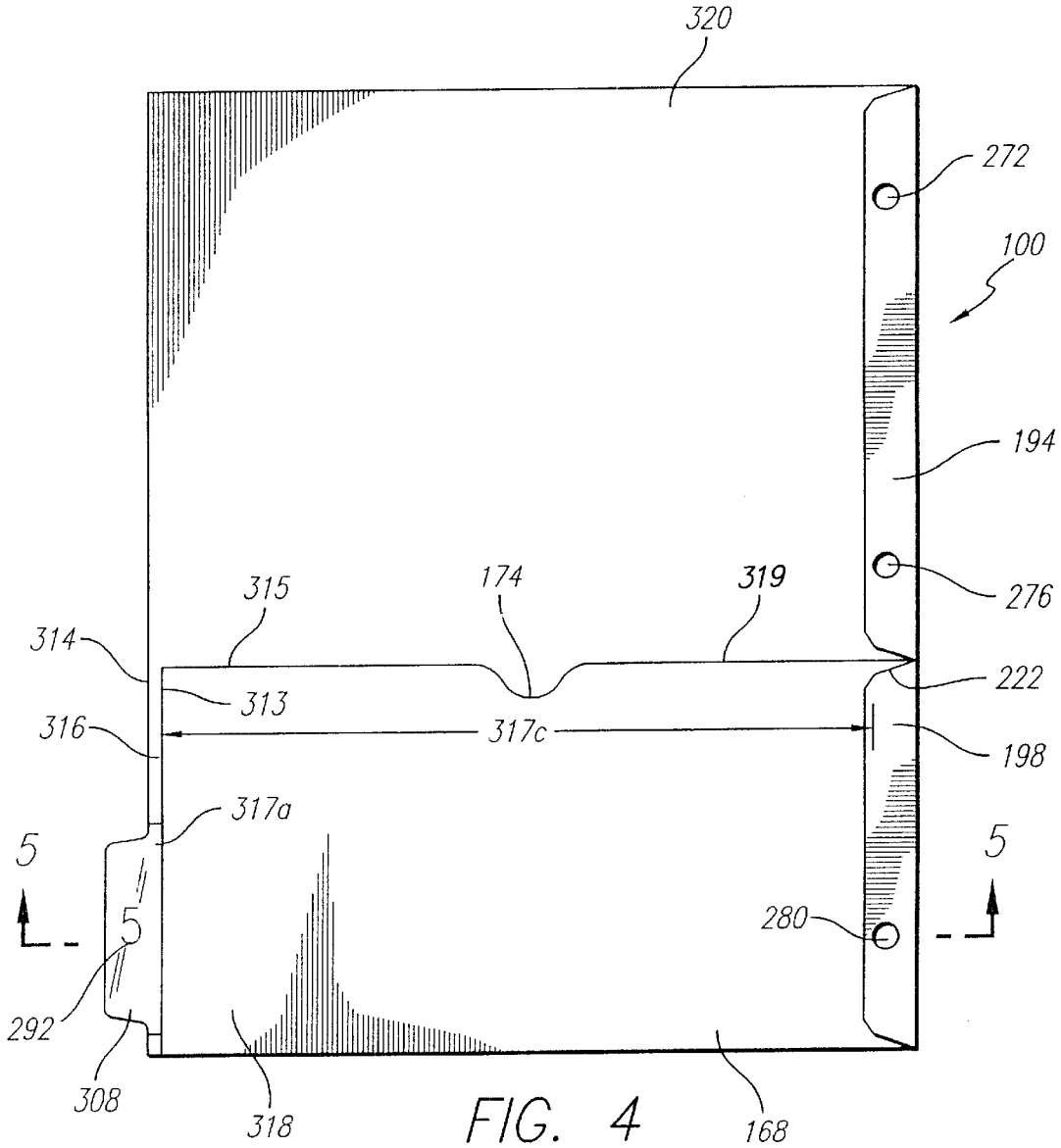
FIG. 4 is a rear elevational view thereof.
Figure 6:
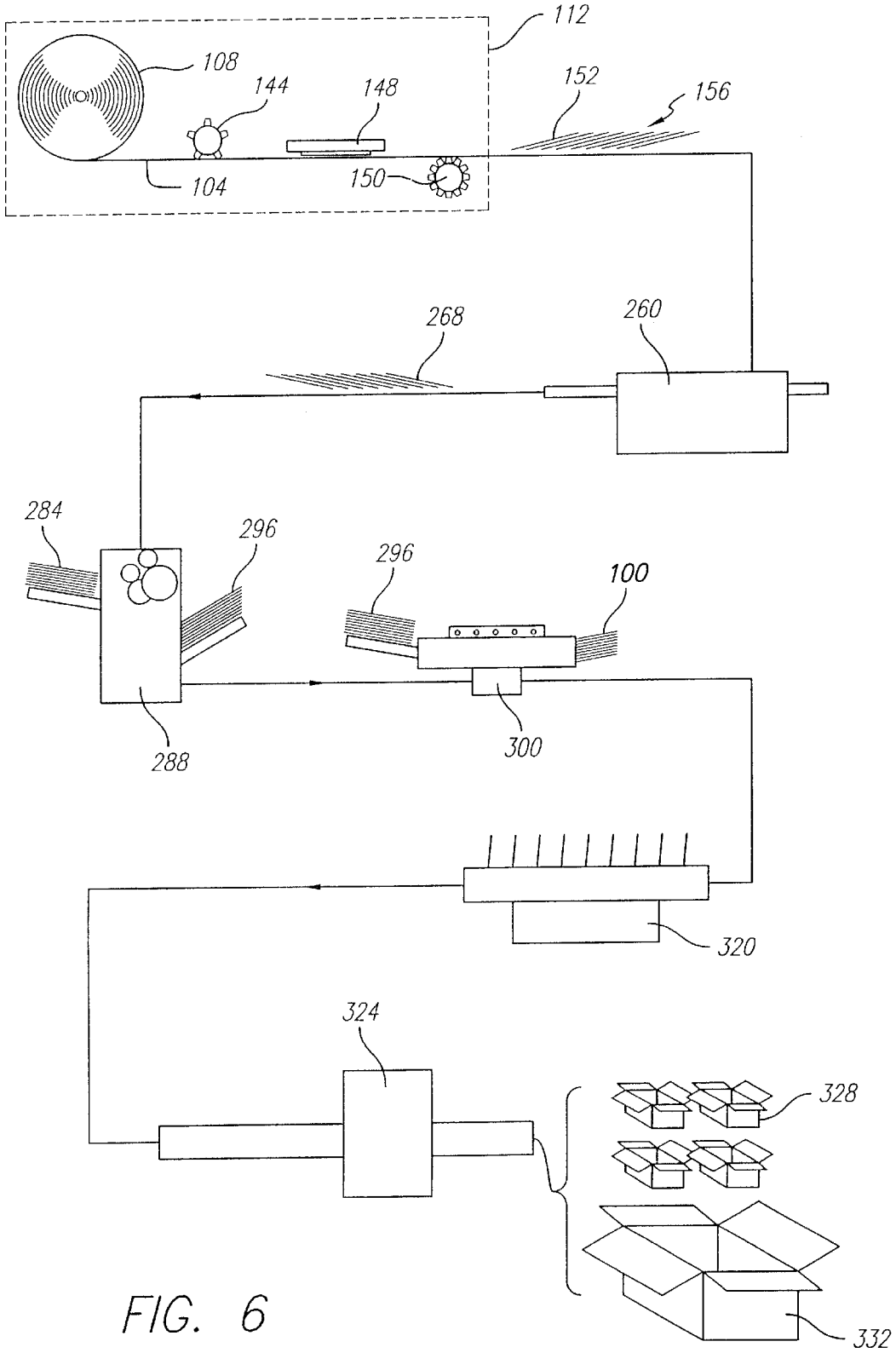
FIG. 6 is a flow diagram illustrating a process for making the tabbed divider and pocket assembly of FIG. 3.

A tabbed divider and pocket assembly of the present invention is shown generally at 100 with its front side depicted in FIG. 3 and its back side in FIG. 4. Assembly 100 is essentially formed from a single sheet of paper which is hole punched, cut, scored, folded and glued in a process which will be described in detail now with reference to FIG. 6. Although FIG. 6 shows the hole punch at the start of the process, it is also within the scope of the invention to have it at the end or more particularly after the folding and gluing but before the printing step. It is seen in that drawing that the paper 104 is provided in a large roll 108. A preferred paper is International Paper's WHITE TAG paper, one hundred pound weight, twenty-percent recycled content, and 0.0074 inch thick. An alternative paper would be a "card" stock, eighty to one hundred-and-twenty pound weight depending on the paper type and whose thickness is generally between 0.006 and 0.0010 inch (depending on the paper or card stock used).

The paper roll 108 is placed in a KEMPSMITH machine, for example, as shown generally at 112. The paper 104 is therein unwound from the roll 108 and binding holes 116, 120, 124, 128, 132, 136, 140 (see FIG. 7, for example) are punched out using a rotary die 144. The paper 104 is reregistered to align the binding holes and cause tension in the paper. More specifically, the paper 104 is kept in place, inside of the die and prior to cutting, by a bar which comes into contact with the paper and an anvil to momentarily stall the paper flow. When the bar comes down, the continuously unwinding paper 104 actually rolls up and creates a small paper wave against the bar.

The paper 104 in the machine 112 is then scored, die cut and sheeted. In addition to the bar-anvil alignment, alignment of the paper 104 is assisted by the fact that the paper is not sheeted or cut into its final length until the last/furthest blade on the die cuts the paper. Essentially a square die 148 is used that has its front blade removed and its last blade in place so a constant feeding, cutting, feeding, cutting of the sheets is provided. That is, when the die 148 comes down the first time, it cuts the leading edge of the product. And when it comes down the second time, it cuts both the trailing edge of the first product and the leading edge of the second product. The process is continuous, and the paper 104 is held under tension and does not "swim" around in the die 148 so that accurate, consistent cutting and scoring are ensured.

Figure 7:
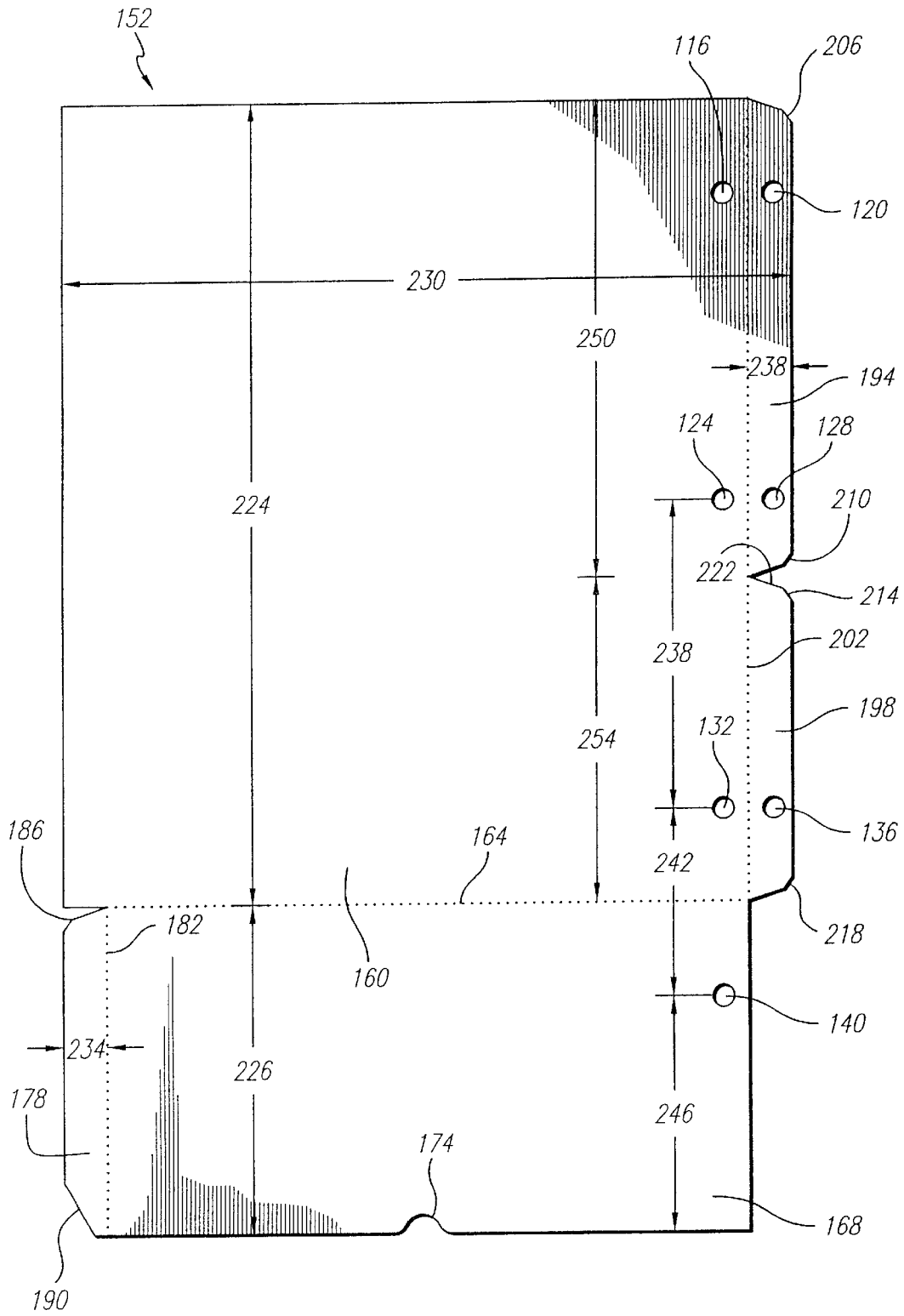
FIG. 7 is a rear plan view of the assembly in a first stage of the process as shown in the flow diagram of FIG. 6.

The scoring and cutting steps are at the same time, followed by the sheeting step, all by the die 148. A stripper 150 then removes the excess paper matrix. The sheets 152 thereby produced are loosely stacked coming off of machine 112 in a stack 156 and the stacks are manually aligned and removed, ready for transport to the next station. The sheet 152 at this stage in the manufacturing process is shown in FIG. 7.

In addition to the binding holes 116, 120, 124, 128, 132, 136, 140, the sheet 152 includes a main body portion 160, separated by a bottom fold line 164 from a pocket panel 168. All of the fold lines are score lines where the scoring extends generally eighty-percent through the thickness of the paper. The pocket panel 168 has a centered indent or finger notch 174 provided to assist in easy opening of the pocket when inserting collateral materials. The notch can also provide an aesthetic product distinguishing design feature. A pocket side flap 178 is separated from the pocket panel 168 by a pocket side fold line 182. The two free corners 186, 190 of the pocket side flap 178 are both cut at an angle and with rounded corners to prevent them from being caught and pulled away.

Upper and lower side flaps 194, 198 are separated from the main body portion 160 by a side score line 202. The exposed corners 206, 210 of the upper side flap 194 and the exposed corners 214, 218 of the lower side flap 198 are all angle cut with rounded corners. The adjacent angle cut corners 210, 214 define a V-cut as shown by reference numeral 222 and whose purpose will be explained later. Referring to FIG. 7, the sheet 152 as designated by reference numerals 224, 226, 230, 234, 238, 242, 246, 250, and 254, has dimensions (in inches) 11.0, 4.5, 9.56, 0.594, 4.250, 2.5, 3.25, 6.47, and 4.54, respectively.

Figure 5:
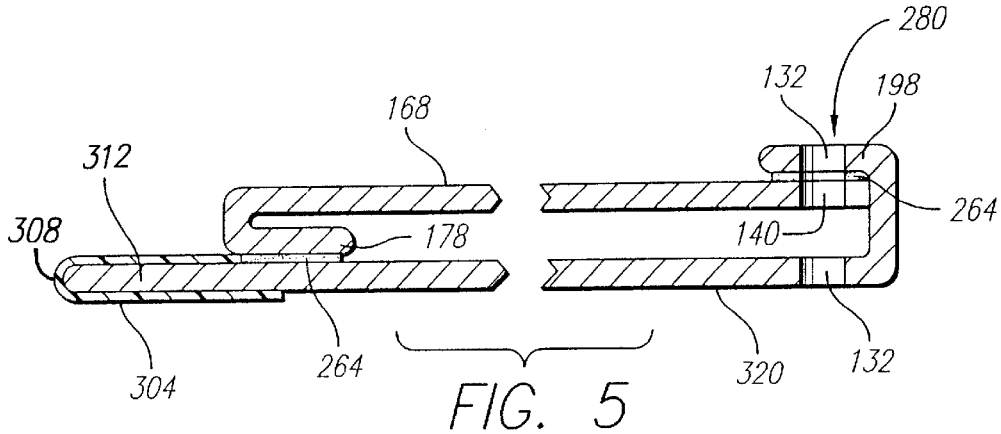
FIG. 5 is an enlarged partial, cross-sectional view taken on line 5—5 of FIG. 4.

Referring back to FIG. 6, the sheets 152 in stack 156 are then transported to and stacked on the feeder of the folder/gluer machine 260, such as the MARATHON machine available from Dick Moll & Sons of Pennsylvania. The preferred machine 260 would be able to complete the folding and gluing using a regulated amount of glue at a speed consistent with the production of the machine 112, which can be eight thousand units per hour. The machine 260 folds the pocket side flap 178 in towards the pocket panel 168 on the fold line 182 and folds the pocket panel up towards back side of the main body portion 160 on fold line 164. The folded under pocket side flap 178 is then glued to the main body portion 160 using glue 264, such as the hot melt adhesive glue available from H.B. Fuller of St. Paul, Minn. It is also within the scope of the invention to use a wet cold adhesive instead of the hot melt adhesive. Glue 264 is shown in FIG. 5. Lower side flap 198 is then folded in and glued (using glue 264) to an outer surface of the pocket panel 168. And upper side flap 194 is folded in and glued (also using glue 264) to the back side of the main body portion 160.

The folded and glued sheet thereby formed is shown generally at 268 in FIG. 8. As can be seen binding holes 116 and 120 are aligned to define an upper binder hole 272 of assembly 20, holes 124 and 128 are aligned to form center binder hole 276, and holes 132, 136 and 140 are aligned to form bottom binder hole 280. Upper side flap 194 thereby acts as a reinforcement for the upper and center binder holes 272, 276 to prevent tearing thereof, unlike in the prior art assembly 20 which is only partially reinforced. As can be seen in FIG. 8, the tab of the assembly 20 has not yet been formed.

One embodiment dimensions all of the holes 116, 120, 124, 128, 132, 136 and 140 with the same diameter, namely 0.281 inch (9/32 inch). A preferred design, however, makes the binding hole 140 a little bit larger with a diameter of 0.3125 inch (5/16 inch). When the sheet is folded and glued, the hole 140 is hidden, sandwiched between holes 132 and 136. Since hole 140 is a little bit larger, it can "float" in between the main body portion 160 and the side flap 198 and hide any minor misalignment of the holes. Similarly, flap holes 120, 128 and 136 can be a little larger (0.3125 versus 0.281 inch) than corresponding body portion holes 116, 124 and 132. These larger holes accommodate minor hole misalignments, but are not that noticeable since they are on the back side of the assembly.

The sheets 268 are then stacked as shown by stack 284 in FIG. 6, and the stacks are positioned on the infeed of the printing press 288. An example of a preferred printing press 288 is the sheet-fed press available from Ryobi of Japan.

Press 288 prints the indicia (preferably the same) 292 on both sides of the tab area of the sheet 268. The indicia 292 will usually be sequential numbers (such as 1–5) or letters (such as A–E), but can be other things such as months of the years. (The present invention also includes a non-printed tab alternative.) The sheets produced from the printing press 288 are shown generally at 296 in FIG. 9.

Sheets 296, referring back to FIG. 6, are stacked, transported to and fed into the tab cutting machine 300. An example of a tab cutting machine 300 is the ARC Tab Cutting machine available from EZ Machine of Farmingdale, N.Y. In the machine 300, MYLAR is unwound from a roll, folded asymmetrically and applied to both sides of sheet 296 where the indicia 292 is printed, that is, on the tab area. The MYLAR is pre-heated and also rolls through additional heat and pressure to form a polyester (plastic) film coating 304 over the tab area. The machine 300 then die cuts the tab area to form the tab 308. The tab 308 includes the tab portion 312 of the sheet 104 (and continuous and integral with the main body portion 160), the ink printed indicia 292 and the coating 304. The assembly 100 is thereby formed as shown in FIG. 10 (and FIG. 4). The MYLAR coating 304 preferably extends beyond the tab portion 312 and onto the sheet 104 to reinforce (add durability and strength to) the tab and make it less likely that it will tear away from the sheet. As can be seen in FIG. 4, if the edge 313 of the pocket is aligned with the edge 314 of the sheet, then any MYLAR coating which extends past the tab portion 312 when the tab portion is adjacent the top edge 315 of the pocket will extend over the pocket top edge. This will seal top edge reducing the size of the opening. Additionally, if the MYLAR extends over the pocket edge, the MYLAR would tend to tear when articles were placed in the pocket and thereby damaging the tab itself.

Accordingly, the present invention uniquely configures the pocket to provide a thin exposed strip 316 of the sheet between edges 313 and 314. Strip 316 allows for a narrow coating flap 317*a* on the back side of the sheet adjacent the tab portion 312. While the coating flap 317*a* has a narrow width of approximately 1/16–1/4 inch, the coating flap 317*b* (FIG. 3) on the front side has a wider more typical width of approximately 1/3–1/2 (or 1/2–1) inch. While flap 317*b* has a length of approximately 2.5 inches, flap 317*a* has a length of approximately 2.0 inches. The different widths (and lengths) give the MYLAR an asymmetrical shape. Also, the strip 316 provides a safety zone so that the pocket is not slit when the tab portion 312 is die cut. Since the MYLAR does not extend over the pocket edge 315 and reduce the pocket opening size, the pocket opening as defined by dimension 317*c* from edge 313 to the closest edge of hole 280 is sufficient to allow an eight-and-a-half by eleven inch sheet to be inserted into the pocket.

Another alternative is to print an entire roll or web prior to die cutting. A further alternative, instead of using MYLAR, prints a glossy coating over the tab to protect it. A still further alternative is to not print on the tab or apply a MYLAR coating, but rather apply a coating which is receptive to laser or inkjet printing to allow the individual user to print indicia as he/she desires. The tabs 308 are formed preferably at five, eight, ten, twelve or fifteen spaced locations along the right edge of the sheet. FIGS. 3 and 4 show the tab 308 at a lower position, and FIG. 10 shows it at a central position. Since the tabs can extend all of the way down the sheet edge, this advantageously allows consumers to run a Table of Contents page through a laser or inkjet printer using existing preset layouts in popular word processing programs, such as Microsoft WORD or WORDPERFECT.

An alternative manufacturing process of this invention applies the MYLAR coating and cuts the tab before the folding and gluing step(s). More specifically, the process steps pursuant to this alternative would be in the following order: (1) punch holes and die cut using machine 112; (2) the indicia is printed on the full unfolded sheet using printing press 288; (3) the MYLAR coating is applied and the tab is cut using tab cutting machine 300; and (4) the tabbed sheet is folded and glued using the folder/gluer machine 260. This alternative process allows for the MYLAR strip to be symmetrically wrapped and secured. The MYLAR strip on the rear side of the divider sheet would then be hidden under the pocket for the bottom tab or two, and the side edge of the pocket would then be aligned with the sheet. In other words, no thin exposed strip 316 would be provided. However, to keep the look consistent on the folded side/back side, the MYLAR strip can still be applied asymmetrically using this alternative process.

The assembly 100 has a (deep four inch) pocket shown generally at 318 with an open top 319 formed (312) on the back side of the divider sheet 320. Positioning of the pocket on the back of the sheet allows for the organization of information within each section. In other words, the assemblies 100 in a three ring binder (not shown) divide the three hole papers in the binder into sections. With an assembly 100 flipped to the left side of the binder to expose the first sheet in the corresponding section, the pocket 318 is exposed and the materials in the pocket can be easily accessed while viewing the first sheet following the assembly in the binder. Additionally, the V-cut 222 being positioned at a corner of a top of the pocket 319 (as shown in FIG. 4 for example) allows the full size of the open top to be utilized so that eight-and-a-half by eleven inch paper sheets can easily and completely fit into the pocket. The V-cut 222 is preferably formed with a thirty degree angle. Instead of a V-shape, "cut" 222 can be configured with a U-shape which better distributes the loads than the V-shape with its junction point.

With reference again to FIG. 6, the assemblies 100 are stacked, transported to and fed into the collater 320 where they are collated into five or eight (or other) tab sets. The sets are transported to the bagger/heat sealing unit 324 where they are bagged—poly wrapped with a heat seal. The packaged products are then put into cases 328 and the cases put into larger shipping boxes 332. The boxed product is then sent to retail outlets or otherwise distributed to the user.

From the foregoing detailed description, it will be evident that there are a number of changes, adaptations and modifications of the present invention which come within the province of those skilled in the art. For example, the top side flap and/or the pocket panel, pocket side flap and bottom side flap pocket arrangement can be used where no tab is provided and/or where the tab is an attached plastic piece as used in the earlier-described Avery prior art product. Another modification is that the pocket panel is dimensioned so as to extend up beyond the center binder hole. A further definition of the invention includes binder hole reinforcing flaps on a product without a tab and/or pocket. However, it is intended that all such variations not departing from the spirit of the invention be considered as within the scope thereof.

What is claimed is:

1. A tabbed divider and pocket assembly, comprising:

a continuous sheet having a sheet body portion, a sheet tab portion extending out from a side edge of the sheet body portion and a sheet pocket panel at a bottom edge of the sheet body portion;

the sheet pocket panel is in a folded-up position and attached along side edges thereof relative to the sheet body portion and thereby defines at least in substantial part with the sheet body portion a pocket having an open top;

the sheet body portion and the sheet tab portion together at least in substantial part define a tabbed divider including a divider sheet and a tab extending laterally out from a side edge of the divider sheet; and the continuous sheet includes a sheet pocket flap extending out from a side edge of the sheet pocket panel, the sheet pocket flap being in a folded under position and secured to the sheet body portion, between the sheet pocket panel and the sheet body portion, wherein an exposed strip of the sheet body portion is provided between the sheet pocket flap and a side edge of the sheet body portion.

2. The assembly of claim 1 wherein the sheet pocket panel includes a central finger notch.

3. The assembly of claim 1 wherein the pocket is on a back side of the divider sheet.

4. The assembly of claim 1 wherein the sheet pocket flap is glued to a rear face of the sheet body portion.

5. The assembly of claim 1 wherein the continuous sheet further includes a lower side flap extending out from a side edge of the sheet body portion opposite to that of the sheet tab portion, the lower side flap being folded and secured on the sheet pocket panel in the folded-up position.

6. The assembly of claim 5 wherein the lower side flap is glued to an outward face of the sheet pocket panel.

7. The assembly of claim 1 wherein the continuous sheet includes a score line at the bottom edge of the sheet body portion and separating the sheet pocket panel from the sheet body portion and a score line separating the sheet pocket flap from the sheet pocket panel.

8. The assembly of claim 1 wherein the sheet pocket panel extends from the bottom edge of the sheet body portion.

9. The assembly of claim 1 wherein the continuous sheet includes a fold line separating the bottom edge and the sheet pocket panel.

10. The assembly of claim 1 wherein the sheet pocket panel in the folded-up position is folded up toward a top edge of the sheet body portion.

11. A tabbed divider and pocket assembly, comprising:

a continuous sheet having a sheet body portion, a sheet tab portion extending out from a side edge of the sheet body portion and a sheet pocket panel at a bottom edge of the sheet body portion;

the sheet pocket panel is in a folded-up position and attached along opposing first and second side edges thereof relative to the sheet body portion and thereby defines at least in substantial part with the sheet body portion a pocket having an open top;

the first side edge being adjacent to but spaced a small distance in from the side edge such that a narrow strip of the sheet body portion between the first side edge and the side edge of the sheet body portion is defined;

the sheet tab portion having a first side corresponding to a pocket side of the sheet body portion and an opposite second side; and a coating on the sheet tab portion on the first side and extending on to the narrow strip, the coating on the narrow strip defining a coating flap.

12. The assembly of claim 11 wherein the coating defines a first coating, and the coating flap defines a first coating flap, and further comprising a second coating on the second side of the sheet tab portion, the second coating extending on to the sheet body portion and defining a second coating flap thereon, the second coating flap is wider than the first coating flap.

13. The assembly of claim 11 wherein the coating is a polyester film.

14. The assembly of claim 11 wherein the sheet includes a pocket flap extending out from a side edge of the pocket panel, the pocket flap is folded under and adhered to the sheet body portion and thereby forms an attachment of the first side edge to the sheet body portion.

15. The assembly of claim 11 wherein an edge portion of the sheet body opposite to the first side edge includes binder holes.

16. The assembly of claim 11 wherein an upper side flap extends out from an upper side edge of the sheet body portion.

17. The assembly of claim 11 further comprising:

a flap extending out from a side edge of the sheet body portion;

the flap having a flap binder hole;

the sheet pocket panel having a side edge portion adjacent to said second edge;

the flap being folded onto and adhered to the side edge portion; and the side edge portion having a binder hole substantially aligned with the flap binder hole.

18. The assembly of claim 11 wherein the sheet tab portion is continuous with the sheet body portion.

19. The assembly of claim 12 wherein the second coating flap has a width of approximately ⅓–½ inch and the first coating flap has a width of approximately 1/16–¼ inch.

20. The assembly of claim 16 wherein the upper side flap is between an upper edge of the pocket portion and an upper edge of the sheet body portion.

21. The assembly of claim 17 wherein the sheet tab portion extends out from the side edge of the sheet body in a direction opposite from the side edge portion having the binder hole.

22. A reinforced binder hole sheet assembly, comprising:

a continuous sheet having a sheet body portion, the sheet body portion having an edge and a sheet edge portion along the edge;

a tab extending out from the sheet body portion;

the sheet having an upper flap extending out from the edge and separated from the sheet body portion by a first fold line along the edge;

the sheet body portion having a body binder first hole through the sheet edge portion;

the upper flap having an upper flap binder hole;

the upper flap being folded onto and adhered to the sheet edge portion such that the upper flap and binder first holes are aligned;

the upper flap providing reinforcement for the body binder first hole against tearing;

the sheet having a lower flap generally separate from the upper flap, extending out from the edge and separated from the sheet body portion by a second fold line;

the sheet body portion having a body binder second hole through the edge sheet portion;

the lower flap having a lower flap binder hole; and the lower flap being folded on the second fold line such that the lower flap and the binder second hole are aligned.

23. The assembly of claim 22 wherein the lower flap provides reinforcement for the body binder second hole against tearing.

24. The assembly of claim 22 wherein the upper and lower flap binder holes are slightly larger than the body binder first and second holes, respectively.

25. The assembly of claim 22 wherein glue adheres the upper flap to the sheet edge portion.

26. The assembly of claim 22 wherein the edge defines a side edge and the sheet edge portion defines a sheet side edge portion.

27. The assembly of claim 22 wherein the first and second fold lines are score lines on the sheet.

28. The assembly of claim 22 where the sheet is a paper sheet.

29. The assembly of claim 22 wherein the tab is continuous and integral with the sheet.

30. The assembly of claim 22 wherein the flaps are folded onto a rear side of the sheet body portion.

31. The assembly of claim 22 wherein a cut line separates the two flaps.

32. The assembly of claim 22 wherein the continuous sheet includes a pocket attached to the sheet body portion and the lower flap is secured directly to the pocket.

33. The assembly of claim 22 wherein the upper flap binder hole defines a first flap hole, the upper flap includes a second flap hole, and the upper body portion includes a body binder third hole aligned with the second flap hole.

34. A tabbed divider and pocket assembly, comprising:

a continuous sheet having a sheet body portion, a sheet tab portion extending out from a lower side edge of the sheet body portion and a sheet pocket panel at a bottom edge of the sheet body portion;

the sheet pocket panel is in a folded-up position and attached along side edges thereof relative to the sheet body portion and thereby defines at least in substantial part with the sheet body portion a pocket having an open top;

the sheet body portion and the sheet tab portion together at least in substantial part define a tabbed divider including a divider sheet and a tab extending laterally out from a lower portion of a side edge of the divider sheet and laterally adjacent one of the attached side edges of the sheet pocket panel;

the continuous sheet includes an upper side flap extending out from an upper side edge of the sheet body portion and folded on and secured to the sheet body portion;

the continuous sheet further includes a lower side flap extending out from a lower side edge of the sheet body portion and folded on and secured to the sheet pocket panel in the folded up position; and a lower end of the upper side flap and an upper end of the lower side flap are adjacent one another and separated by a V-cut.

35. The assembly of claim 34 wherein an upper edge corner of the sheet pocket panel is directly beneath the V-cut.

36. A tabbed divider and pocket assembly, comprising:

a continuous sheet having a sheet body portion, a sheet tab portion extending out from a side edge of the sheet body portion and a sheet pocket panel at a bottom edge of the sheet body portion;

the sheet pocket panel is in a folded-up position and attached along side edges thereof relative to the sheet body portion and thereby defines at least in substantial part with the sheet body portion a pocket having an open top;

the sheet body portion and the sheet tab portion together at least in substantial part define a tabbed divider including a divider sheet and a tab extending laterally out from a side edge of the divider sheet;

the continuous sheet includes an upper side flap extending out from an upper side edge of the sheet body portion and folded on and secured to the sheet body portion;

a binder hole passing through the upper side flap and the sheet body portion;

the continuous sheet further includes a lower side flap extending out from a lower side edge of the sheet body portion and folded on and secured to the sheet pocket panel; and a lower end of the upper side flap and an upper end of the lower side flap are adjacent one another and separated by a V-cut.

37. The assembly of claim 36 wherein a corner of an upper edge of the sheet pocket panel is directly at the V-cut.

38. A tabbed divider and pocket assembly, comprising:

a continuous sheet having a sheet body portion, a sheet tab portion extending out from a side edge of the sheet body portion and a sheet pocket panel at a bottom edge of the sheet body portion;

the sheet pocket panel is in a folded-up position and attached along side edges thereof relative to the sheet body portion and thereby defines at least in substantial part with the sheet body portion a pocket having an open top;

the sheet body portion and the sheet tab portion together at least in substantial part define a tabbed divider including a divider sheet and a tab extending laterally out from a side edge of the divider sheet, the continuous sheet includes an upper side flap extending out from an upper side edge of the sheet body portion and folded on and secured to the sheet body portion;

a binder hole passing through the upper side flap and the sheet body portion;

the continuous sheet further includes a lower side flap extending out from a lower side edge of the sheet body portion and folded on and secured to the sheet pocket panel; and a lower edge of the upper side flap is spaced above a top edge of the sheet pocket panel.

39. A tabbed divider and pocket assembly, comprising:

a continuous sheet having a sheet body portion, a sheet tab portion extending out from a side edge of the sheet body portion and a sheet pocket panel at a bottom edge of the sheet body portion;

the sheet pocket panel is in a folded-up position and attached along side edges thereof relative to the sheet body portion and thereby defines at least in substantial part with the sheet body portion a pocket having an open top;

the sheet body portion and the sheet tab portion together at least in substantial part define a tabbed divider including a divider sheet and a tab extending laterally out from a side edge of the divider sheet;

the continuous sheet includes an upper side flap extending out from an upper side edge of the sheet body portion and folded on and secured to the sheet body portion;

a binder hole passing through the upper side flap and the sheet body portion; and the continuous sheet includes a score line at the bottom edge of the sheet body portion and separating the sheet pocket panel from the sheet body portion, and a score line at the upper side edge and separating the upper side flap from the sheet body portion.

40. A tabbed divider and pocket assembly, comprising:

a continuous sheet having a sheet body portion, a sheet tab portion extending out from a side edge of the sheet body portion and a sheet pocket panel at a bottom edge of the sheet body portion;

the sheet pocket panel is in a folded-up position and attached along side edges thereof relative to the sheet body portion and thereby defines at least in substantial part with the sheet body portion a pocket having an open top;

the sheet body portion and the sheet tab portion together at least in substantial part define a tabbed divider including a divider sheet and a tab extending laterally out from a side edge of the divider sheet;

the continuous sheet includes an upper side flap extending out from an upper side edge of the sheet body portion and folded on and secured to the sheet body portion;

a binder hole passing through the upper side flap and the sheet body portion;

the continuous sheet further includes a lower side flap extending out from a lower side edge of the sheet body portion and folded on and secured to the sheet pocket panel;

the upper side flap and lower side flap are separate; and the upper side flap is attached to the main body portion and the lower side flap is attached to the pocket portion.

41. A tabbed divider and pocket assembly, comprising:

a continuous sheet having a sheet body portion, a sheet tab portion extending out from a lower side edge of the sheet body portion and a sheet pocket panel at a bottom edge of the sheet body portion;

the sheet pocket panel is in a folded-up position and attached along side edges thereof relative to the sheet body portion and thereby defines at least in substantial part with the sheet body portion a pocket having an open top;

the sheet body portion and the sheet tab portion together at least in substantial part define a tabbed divider including a divider sheet and a tab extending laterally out from a lower portion of a side edge of the divider sheet and laterally adjacent one of the attached side edges of the sheet pocket panel;

the continuous sheet includes a sheet side flap extending out from a side edge of the sheet body portion opposite to that of the sheet tab portion, and the sheet side flap is folded and secured on the sheet pocket panel with the sheet pocket panel in the folded-up position;

the sheet side flap is glued to an outward face of the folded-up sheet pocket panel; and a binder hole passes through the sheet side flap, the sheet pocket panel and the sheet body portion.

42. A tabbed divider and pocket assembly, comprising:

a continuous sheet having a sheet body portion, a sheet tab portion extending out from a lower side edge of the sheet body portion and a sheet pocket panel at a bottom edge of the sheet body portion;

the sheet pocket panel is in a folded-up position and attached along side edges thereof relative to the sheet body portion and thereby defines at least in substantial part with the sheet body portion a pocket having an open top; and the sheet body portion and the sheet tab portion together at least in substantial part define a tabbed divider including a divider sheet and a tab extending laterally out from a lower portion of a side edge of the divider sheet and laterally adjacent one of the attached side edges of the sheet pocket panel; and the continuous sheet includes an upper side flap extending out from an upper side edge of the sheet body portion and folded on and glued to the sheet body portion.

43. The assembly of claim 42 wherein a binder hole passes through the upper side flap and the sheet body portion.

44. The assembly of claim 42 wherein the continuous sheet further includes a lower side flap extending out from a lower side edge of the sheet body portion and folded on and secured to the sheet pocket panel in the folded-up position.

45. The assembly of claim 43 wherein the binder hole defines a center binder hole positioned at a middle of a side portion of the divider sheet.

46. The assembly of claim 45 wherein an upper binder hole is spaced above the center binder hole and passes through the upper side flap and the sheet body portion.

47. A tabbed divider and pocket assembly, comprising:

a continuous sheet having a sheet body portion, a sheet tab portion extending out from a side edge of the sheet body portion and a sheet pocket panel at a bottom edge of the sheet body portion;

the sheet pocket panel is in a folded-up position and attached along side edges thereof relative to the sheet body portion and thereby defines at least in substantial part with the sheet body portion a pocket having an open top;

the sheet body portion and the sheet tab portion together at least in substantial part define a tabbed divider including a divider sheet and a tab extending laterally out from a side edge of the divider sheet;

the continuous sheet includes an upper side flap extending out from an upper side edge of the sheet body portion and folded on and secured to the sheet body portion;

a binder hole passing through the upper side flap and the sheet body portion; and the upper side flap is glued to a rear face of the sheet body portion.

48. A tabbed divider and pocket assembly, comprising:

a continuous sheet having a sheet body portion, a sheet tab portion extending out from a side edge of the sheet body portion and a sheet pocket panel at a bottom edge of the sheet body portion;

the sheet pocket panel is in a folded-up position and attached along side edges thereof relative to the sheet body portion and thereby defines at least in substantial part with the sheet body portion a pocket having an open top;

the sheet body portion and the sheet tab portion together at least in substantial part define a tabbed divider including a divider sheet and a tab extending laterally out from a side edge of the divider sheet;

the continuous sheet includes an upper side flap extending out from an upper side edge of the sheet body portion and folded on and secured to the sheet body portion;

a binder hole passing through the upper side flap and the sheet body portion; and the continuous sheet further includes a lower side flap extending out from a lower side edge of the sheet body portion and folded on and glued to the sheet pocket panel.

49. A tabbed divider and pocket assembly, comprising:

a continuous sheet having a sheet body portion, a sheet tab portion extending out from a lower side edge of the sheet body portion and a sheet pocket panel at a bottom edge of the sheet body portion;

the sheet pocket panel is in a folded-up position and attached along side edges thereof relative to the sheet body portion and thereby defines at least in substantial part with the sheet body portion a pocket having an open top; and the sheet body portion and the sheet tab portion together at least in substantial part define a tabbed divider including a divider sheet and a tab extending laterally out from a lower portion of a side edge of the divider sheet and laterally adjacent one of the attached side edges of the sheet pocket panel;

wherein no part of the assembly has no more than three layers of sheet portions.

50. A tabbed divider and pocket assembly, comprising:

a continuous sheet having a sheet body portion, a sheet tab portion extending out from a side edge of the sheet body portion and a sheet pocket panel at a bottom edge of the sheet body portion;

the sheet pocket panel is in a folded-up position and attached along side edges thereof relative to the sheet body portion and thereby defines at least in substantial part with the sheet body portion a pocket having an open top;

the sheet body portion and the sheet tab portion together at least in substantial part define a tabbed divider including a divider sheet and a tab extending laterally out from a side edge of the divider sheet;

the continuous sheet includes a lower side flap extending out from a lower side edge of the sheet body portion and folded on and attached to the sheet body portion;

a binder hole passing through the lower side flap and the sheet body portion and the pocket panel; and the lower side flap is glued to a rear face of the sheet body portion;

wherein said attached pocket panel and said attached lower side flap are attached to the sheet body portion in substantially parallel direction.

51. The tabbed divider and pocket of claim 50, further comprising:

an upper side flap extending out from an upper side edge of the sheet body portion and folded on and attached to the sheet body portion.

52. The tabbed divider and pocket of claim 50, wherein said attached pocket panel and said attached lower side flap are attached to the sheet body portion with glue.

53. The tabbed divider and pocket of claim 50, wherein said attached pocket panel includes a side pocket flap that is folded under and attached to the sheet body portion with glue.

54. The tabbed divider and pocket of claim 50, wherein said sheet body portion and said sheet pocket panel are separated by a weakened line extending therebetween.

* * * * *